US007359486B2

(12) United States Patent
Subraya et al.

(10) Patent No.: US 7,359,486 B2
(45) Date of Patent: Apr. 15, 2008

(54) STRUCTURE FOR COLLECTING SCATTERED ELECTRONS

(75) Inventors: Madhusudhana T. Subraya, New Berlin, WI (US); Michael Scott Hebert, Muskego, WI (US); Gregory Alan Steinlage, Hartland, WI (US)

(73) Assignee: General Electric Co., Schenectady, NY (US)

( * ) Notice: Subject to any disclaimer, the term of this patent is extended or adjusted under 35 U.S.C. 154(b) by 49 days.

(21) Appl. No.: 11/306,233

(22) Filed: Dec. 20, 2005

(65) Prior Publication Data

US 2007/0140432 A1 Jun. 21, 2007

(51) Int. Cl.
*H01J 35/10* (2006.01)
*H01J 35/12* (2006.01)

(52) U.S. Cl. ..... 378/141; 378/142

(58) Field of Classification Search ..... 378/119, 378/121, 210, 136–138, 140–144, 199, 200, 378/127, 128
See application file for complete search history.

(56) References Cited

U.S. PATENT DOCUMENTS 3,609,432 A * 9/1971 Shimula ..... 378/141
4,607,380 A 8/1986 Oliver
5,828,727 A * 10/1998 Schild ..... 378/140
5,995,585 A 11/1999 Salasoo
6,115,454 A * 9/2000 Andrews et al. ..... 378/140
6,215,852 B1 4/2001 Rogers et al.
6,263,046 B1 7/2001 Rogers
6,301,332 B1 10/2001 Rogers et al.
6,307,916 B1 10/2001 Rogers et al.
6,385,292 B1 * 5/2002 Dunham et al. ..... 378/122
6,400,799 B1 * 6/2002 Andrews ..... 378/141
6,438,208 B1 8/2002 Koller
6,519,318 B1 2/2003 Andrews
6,690,765 B1 * 2/2004 Miller ..... 378/124
6,714,626 B1 3/2004 Subraya et al.
6,922,463 B2 7/2005 Tang et al.
6,980,628 B2 * 12/2005 Wang et al. ..... 378/140
7,042,981 B2 * 5/2006 Subraya et al. ..... 378/140
2002/0085675 A1 * 7/2002 Snyder et al. ..... 378/130
2002/0146092 A1 * 10/2002 Richardson et al. ..... 378/130
2004/0071268 A1 * 4/2004 Subraya et al. ..... 378/141
2004/0114724 A1 6/2004 Subraya et al.
2004/0223588 A1 11/2004 Subraya et al.

FOREIGN PATENT DOCUMENTS

CH 663114 A5 * 11/1987

* cited by examiner

*Primary Examiner*—Edward J. Glick
*Assistant Examiner*—Anastasia S. Midkiff

(57) ABSTRACT

A structure for collecting scattered electrons within a substantially evacuated vessel containing both an electron-emitting cathode and an electron-attracting anode is disclosed herein. The electron-collecting structure includes a two-sided first plate, a two-sided second plate, a fluid inlet, and a fluid outlet. The first plate is both electrically conductive and thermally emissive and is mountable within the vessel so that its first side at least partially faces the anode. The second plate is also thermally emissive and has a first side that is substantially conterminous with the second side of the first plate. Furthermore, the second plate additionally has an internal conduit for conveying a heat-absorbing fluid within. Both the fluid inlet and the fluid outlet are in fluid communication with the conduit in the second plate. During operation, the structure is able to attract scattered electrons and transfer thermal energy attributable to the electrons away from the structure.

25 Claims, 8 Drawing Sheets

STRUCTURE FOR COLLECTING SCATTERED ELECTRONS

FIELD OF THE INVENTION

The present invention generally relates to electron collectors and more particularly relates to structures for collecting scattered electrons within, for example, a substantially evacuated vessel.

BACKGROUND OF THE INVENTION

Electron beam generating devices, such as x-ray tubes and electron-beam welders, generally operate in high-temperature environments. During operation of an x-ray tube, for example, the primary electron beam generated by its cathode deposits a very large heat load on its anode target such that the target glows red-hot. Typically, less than 1% of the primary electron beam's energy is converted into x-rays, while the balance of its energy is converted into thermal energy. In general, this thermal energy from the hot anode target is radiated to various components within the x-ray tube's vacuum vessel and thereby causes the x-ray tube to heat up. Furthermore, some of the electrons in the electron beam backscatter from the anode target and impinge on these same components within the vacuum vessel, thereby causing additional thermal heating of the x-ray tube. As a result of the elevated temperatures caused by the cumulative effects of such thermal energies, the x-ray tube's components are subjected to high thermal stresses that are sometimes undesirable for proper operation of the x-ray tube itself.

Typically, an x-ray beam generating device, such as an x-ray tube, includes opposing electrodes enclosed within a cylindrical vacuum vessel. The vacuum vessel itself is typically fabricated from glass or a metal, such as stainless steel, copper, or a copper alloy. The electrodes themselves generally comprise a rotating, disc-shaped anode assembly and also a cathode assembly that is positioned at some distance from the target surface or track on the disc-shaped anode assembly. In other applications, the anode or anode assembly may alternatively be stationary. The target surface or track (or impact zone) of the anode is generally fabricated from a refractory metal with a high atomic number, such as tungsten or a tungsten alloy. To properly accelerate electrons toward the anode, a voltage potential difference of about 60 kilovolts (kV) to about 140 kV is typically maintained between the cathode and anode assemblies. In such a configuration, the cathode's hot filament emits electrons that are accelerated across the resultant electric field so that the electrons impact the target track of the rotating anode at high velocities. Typically, only a small fraction of the electrons' kinetic energies is converted into high-energy electromagnetic radiation or x-rays, while the balance of the energies is either retained in backscattered electrons or converted into heat. In general, the resultant x-rays emanate from the electron beam's focal spot on the anode and are therefrom directed out of the vacuum vessel. In an x-ray tube that particularly has a metal vacuum vessel, an x-ray transmissive window is fabricated and incorporated into the wall of the vacuum vessel so as to allow the x-ray beam to exit the vessel at a desired location. After exiting the vacuum vessel, the x-rays are directed so as to irradiate a particular object, such as a region of interest (ROI) within a human's anatomy for medical examination and diagnosis purposes. After the x-rays pass through the object, they are generally intercepted by an x-ray detector, from which an image is generated and formed of the anatomical ROI. Furthermore, in addition to such a medical application, x-ray tubes may alternatively be utilized in industry to, for example, inspect metal parts for cracks or inspect the contents of luggage at an airport.

As alluded to above, many of the electrons incident on the anode are not converted into x-rays and are instead backscattered from the anode's target surface in random directions. For example, up to about 50 percent of electrons incident on an anode target made of tungsten are typically backscattered. These backscattered electrons generally travel on a curvilinear path through the electric field between the cathode and anode until they impact one or more nearby structures or components. During such backscattering, these electrons interact with the electric field and space charge therein, thereby causing their initial trajectories to be altered in a complicated, but predictable, manner. As these backscattered electrons impact internal components of the x-ray tube, their kinetic energies are transferred to the components in the form of thermal energy until generally all of their respective energies are depleted. Furthermore, in addition to transferring thermal energy to the tube's internal components, the impact of backscattered electrons also produces additional x-ray radiation, termed "off-focal x-rays" in medical x-ray applications. In general, the production of such off-focal x-ray radiation tends to degrade x-ray imaging quality if it is allowed to exit the vacuum vessel's x-ray transmissive window.

The paths of backscattered electrons, and therefore the paths of off-focal radiation, can be influenced by the particular electric voltage potential configuration in and about the x-ray tube. In a bi-polar configuration, for example, the cathode is maintained at a negative potential, and the anode is maintained at a positive potential relative to electrical ground, thereby establishing a voltage potential drop and electric field across the gap between the cathode and the anode. In this configuration, a large fraction of electrons initially backscattered from the anode are drawn back to the anode by its electrostatic potential. On the other hand, in a uni-polar configuration, both the anode and vacuum vessel are electrically grounded, and the cathode is maintained at a high negative potential. In this uni-polar configuration, the attractive force of the electrically grounded anode and frame is less than the attractive force of a positively charged anode and frame of an x-ray tube in a bi-polar configuration. Therefore, in a uni-polar configuration, a larger fraction of backscattered electrons can generally be collected and not allowed to return to the anode, thereby significantly enhancing the operating performance of the anode and also decreasing the amount of off-focal x-ray radiation exiting through the transmissive window.

Since the production of x-rays in a conventional x-ray tube is somewhat inherently an energy-inefficient process, the various components within such an x-ray tube typically operate at very high temperatures. For example, the temperature of the anode's target surface during operation exceeds 2000° C. Furthermore, the temperature of much of the anode assembly exceeds 1000° C.

To help cool the x-ray tube, the thermal energy generated during tube operation is generally transferred from the anode and through the vacuum vessel so that it can be removed with a heat-absorbing cooling fluid. To accomplish such, the vacuum vessel itself is typically enclosed in an outer casing that is filled with a circulating cooling fluid such as, for example, a dielectric oil. In such a configuration, the casing further supports and protects the x-ray tube and also provides for attachment to, for example, the rotating gantry of a computed tomography (CT) imaging system. The casing itself may be lined with lead to help shield and prevent any extraneous x-ray radiation from straying from the tube. In general, the cooling fluid in the casing performs two duties. These duties include cooling the vacuum vessel and also providing high-voltage insulation between the anode and cathode connections when in the above-mentioned bi-polar configuration. During operation of the x-ray tube, however, the performance of the cooling fluid may be degraded over time by excessively high temperatures that cause the fluid to boil at the interface between the fluid and the outer surface of the vacuum vessel or vacuum vessel's transmissive window. When the cooling fluid is caused to boil in this manner, large bubbles may form within the fluid that undesirably facilitate high-voltage arcing across the fluid, thus degrading the insulating capability of the fluid. Furthermore, the bubbles may give rise to x-ray image artifacts that produce low-quality images.

In addition to facilitating arcing, excessively high temperatures in an x-ray tube can also decrease the useful life of the tube's transmissive window, as well as other tube components. Because of its conventionally close proximity to an electron beam's focal spot on the anode's target surface during tube operation, the x-ray transmissive window is subjected to very high heat loads resulting from thermal radiation and backscattered electrons. Such high thermal loads on the transmissive window generally necessitate careful tube design to ensure that the window operates properly over the life of the x-ray tube, especially for the purpose of helping maintain a vacuum in the tube's vessel as the transmissive window is an important part the x-ray tube's overall hermetic seal. In general, the high heat loads in an x-ray tube cause very large and cyclic stresses in the transmissive window and can lead to premature failure of the window and its hermetic seal(s). Furthermore, since direct contact of the window (when excessively hot) with the cooling fluid can cause the fluid to boil as it flows over the window, degraded hydrocarbons from the fluid are sometimes apt to deposit on the window's outer surface, which can undesirably reduce x-ray imaging quality.

In view of the above, there is a present need in the art for a system or structure that effectively collects backscattered electrons within an x-ray tube's vacuum vessel and that also effectively transfers thermal energy attributable to such collected electrons from the tube.

SUMMARY OF THE INVENTION

The present invention provides a structure for collecting scattered electrons within a substantially evacuated vessel, which contains both an electron-emitting cathode and an electron-attracting anode spaced apart therein. In one practicable embodiment, the electron-collecting structure includes a two-sided first plate, a two-sided second plate, a fluid inlet, and a fluid outlet. The first plate is both electrically conductive and thermally emissive and is mountable within the vessel so that its first side at least partially faces the anode. The second plate is also thermally emissive and has a first side that is substantially conterminous with the second side of the first plate. Furthermore, the second plate additionally has an internal conduit for conveying a heat-absorbing fluid within. Both the fluid inlet and the fluid outlet are in fluid communication with the conduit in the second plate. During operation, the structure is able to attract scattered electrons within the vessel and transfer thermal energy attributable to the electrons away from the structure.

In addition to the above, it is believed that various alternative embodiments, design considerations, applications, methodologies, and advantages of the present invention will become apparent to those skilled in the art when the detailed description of the best mode contemplated for practicing the present invention, as set forth hereinbelow, is reviewed in conjunction with the appended claims and the accompanying drawing figures.

BRIEF DESCRIPTION OF THE DRAWINGS

The present invention is described hereinbelow, by way of example, with reference to the following drawing figures.

DETAILED DESCRIPTION OF THE INVENTION

Figure 1:
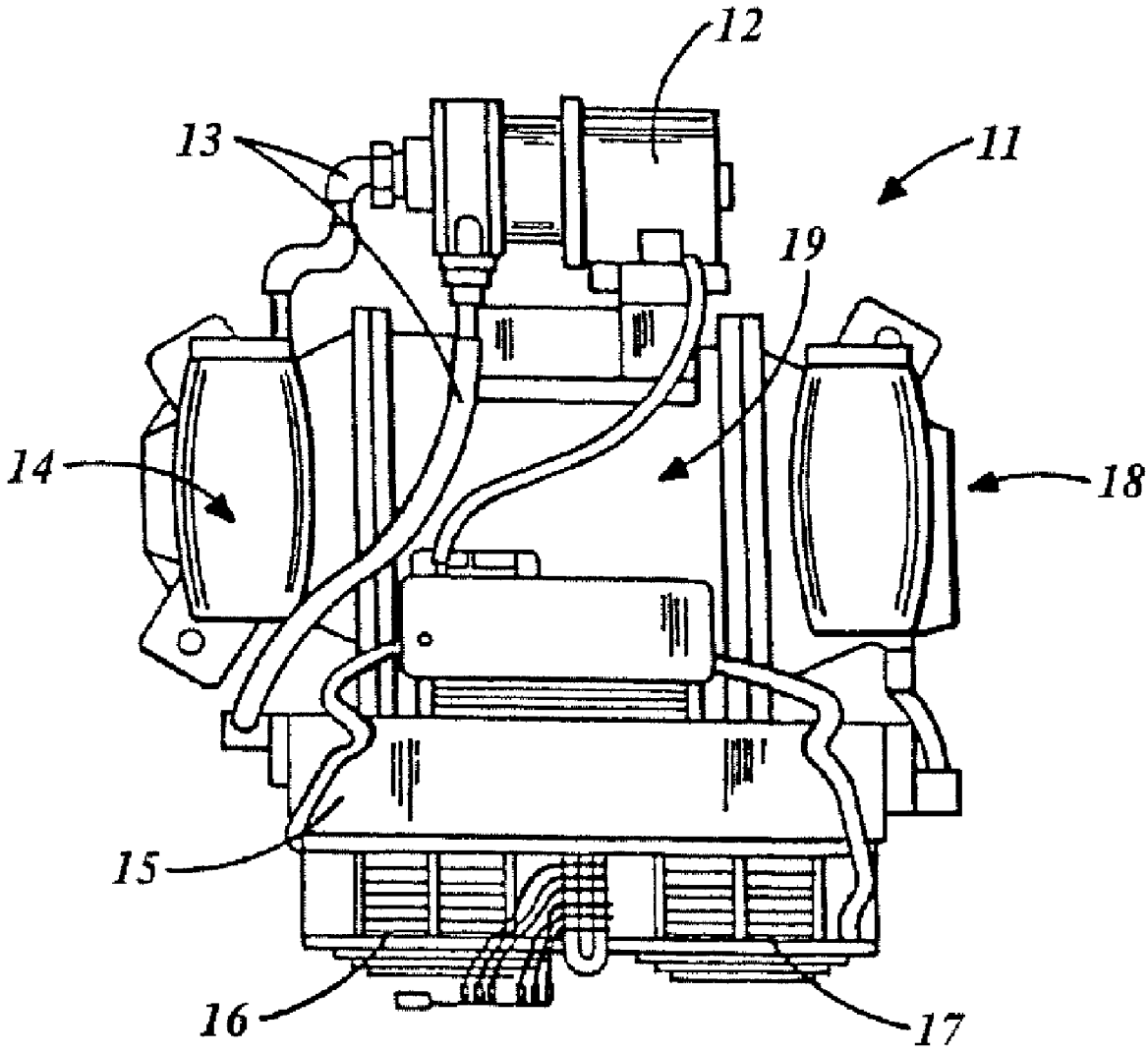
FIG. 1 illustrates a plan view of an x-ray system.

FIG. 1 illustrates a plan (i.e., top) view of a largely conventional x-ray system 11. As shown, the x-ray system 11 generally includes an anode end 14, a cathode end 18, and a center section 19. The center section 19 is situated between both the anode end 14 and the cathode end 18 and contains an x-ray tube 20 that serves to generate x-rays.

Figure 2:
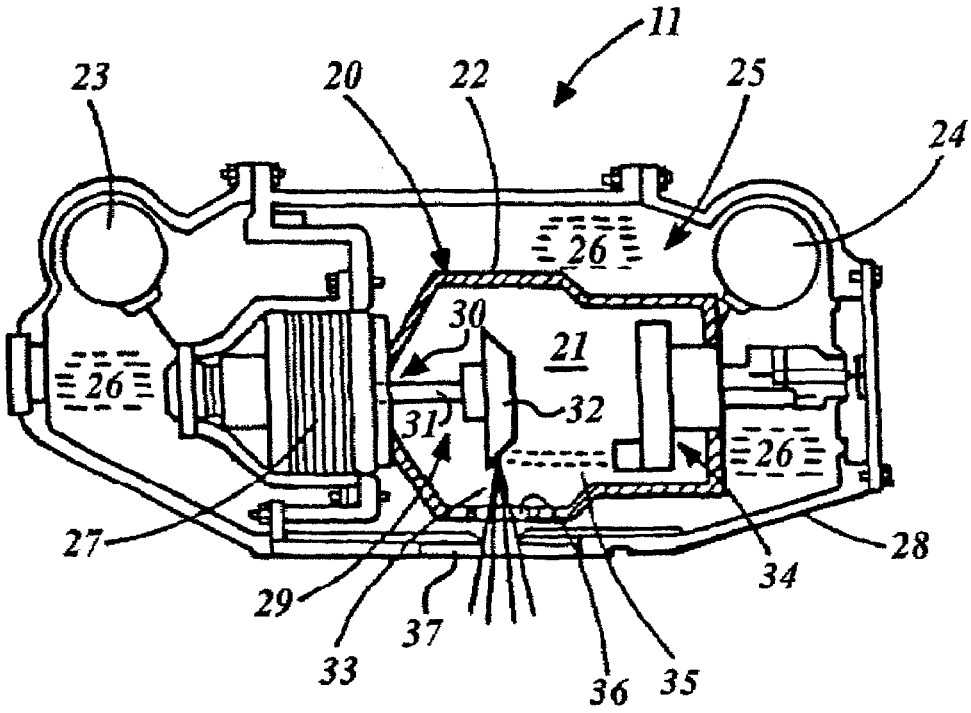
FIG. 2 illustrates a cutaway side view of the x-ray system depicted in FIG. 1. In this view, the x-ray system is shown to include an x-ray tube having both an anode assembly and a cathode assembly situated therein.

FIG. 2 illustrates a sectional side view of the x-ray system 11 depicted in FIG. 1. As shown in FIG. 2, the x-ray tube 20 in the system 11 largely includes a vacuum vessel 22 that is situated in a chamber 25 defined within a casing 28. The vacuum vessel 22 is constructed to endure very high temperatures and includes x-ray transmissive materials such as, for example, glass or Pyrex, and may even include sections of non-transmissive materials such as stainless steel or copper. The casing 28, on the other hand, may include, for example, aluminum and may also be lined with lead to block the passage of x-rays therethrough. Per convention, the chamber 25 within the casing 28 is filled with a heat-absorbing cooling fluid 26 such as, for example, a dielectric oil. During operation of the x-ray system 11, wherein high temperatures are generated in the x-ray tube 20, the cooling fluid 26 is circulated through the system 11 to thereby absorb thermal energy (i.e., heat) from the tube 20 so as to cool the tube 20 and prevent damage thereto. Furthermore, in addition to absorbing heat from the x-ray tube 20, the cooling fluid 26 also serves to electrically insulate the casing 28 from high-voltage electrical charges existing within the tube's vacuum vessel 22.

To circulate the cooling fluid 26 through the x-ray system 11, the system's center section 19, as shown in FIG. 1, has a pump 12 mounted to one side. Mounted as such, the pump 12 is operable to circulate the cooling fluid 26 throughout the x-ray system 11 via a series of fluid hoses 13. To remove absorbed heat from the cooling fluid 26 before the fluid 26 is recirculated through the x-ray system 11 to further cool the tube 20, the system's center section 19 also has an in-line radiator 15 mounted to another side. The radiator 15 has associated cooling fans 16 and 17 operatively mounted thereto for creating a cooling air flow over the radiator 15. In this configuration, any heat absorbed by the cooling fluid 26 is thus largely dissipated by circulating the fluid 26 through the radiator 15.

As further illustrated in FIG. 2, the x-ray system 11 also includes both an anode receptacle 23 and a cathode receptacle 24 that serve as points of connection for electrically energizing the x-ray system 11. Correspondingly, the x-ray tube 20 within the x-ray system 11 includes both an anode assembly 29 in electrical communication with the anode receptacle 23 and a cathode assembly 34 in electrical communication with the cathode receptacle 24. The anode assembly 29 and the cathode assembly 34, in general, are situated in a largely evacuated chamber region 21 defined within the vacuum vessel 22. The anode assembly 29, in particular, includes a beveled disc 32 mounted on one end of a rotatable shaft 31 that extends into the chamber region 21 within the vacuum vessel 22. The cathode assembly 34, on the other hand, includes both a focusing cup and an energizable filament (not particularly shown) situated opposite the disc 32 in the chamber region 21 within the vessel 22. Outside the vacuum vessel 22, the x-ray system 11 further includes a driving induction motor 27 in mechanical communication with the other end of the rotatable shaft 31.

During operation, when the x-ray system 11 is energized by an electrical power supply 38 electrically connected between the anode receptacle 23 and the cathode receptacle 24, a focused stream of electrons 35 is emitted from the filament of the cathode assembly 34 and directed toward the disc 32 of the anode assembly 29. As the electron stream 35 impinges on the surface of the disc 32, the driving induction motor 27 operates to rotate the shaft 31 and disc 32 together at a very high rate of angular speed. In this way, as electrons from the directed electron stream 35 are absorbed and/or deflected at the surface of the rotating disc 32, high-frequency electromagnetic waves or x-rays 33 are thereby produced. In addition to producing such x-rays 33, this same operation, as briefly alluded to hereinabove, also generates large amounts of heat within the vacuum vessel 22 of the x-ray tube 20.

As shown in FIG. 2, the x-rays 33 emanating from the disc 32 pass both through the chamber region 21 of the vacuum vessel 22 and out of the vessel 22 by way of an x-ray transmissive window 36 in the wall of the vessel 22. Thereafter, the x-rays 33 pass through the cooling fluid 26 between the x-ray tube 20 and the casing 28 and then ultimately through another window 37 formed in the wall of the casing 28. As is the inner window 36, the outer window 37 is also x-ray transmissive and may comprise, for example, beryllium. As shown in FIG. 2, the outer transmissive window 37 is situated in the wall of the casing 28 so as to generally be aligned with the inner transmissive window 36 in the wall of the vacuum vessel 22. With both windows 36 and 37 aligned as such, the x-ray system 11 as a whole can thus be oriented so as to directionally focus the x-rays 33 toward a subject or patient 56 for irradiation and imaging purposes.

Figure 3:
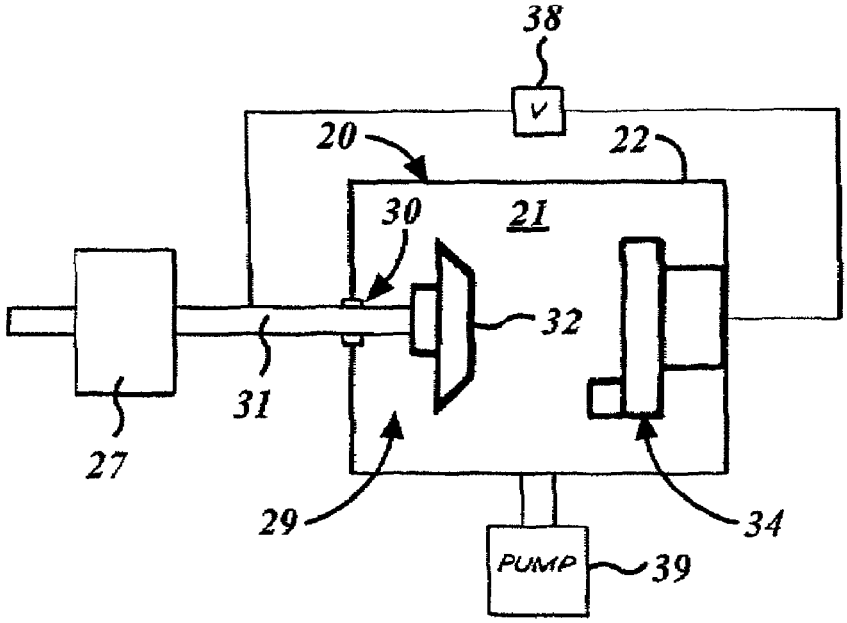
FIG. 3 illustrates a system diagram of the x-ray tube depicted in FIG. 2. In this diagram, the anode assembly within the x-ray tube is shown to be mounted on a rotatable shaft, which is extended into the x-ray tube via a seal system so as to substantially keep the x-ray tube hermetically sealed.

FIG. 3 illustrates a system diagram of the x-ray tube 20 depicted in FIG. 2. In this diagram, the rotatable shaft 31 associated with the anode assembly 29 of the x-ray tube 20 is highlighted. As shown, the shaft 31 extends into the chamber region 21 of the tube's vacuum vessel 22 via a seal-and-bearing system 30 so as to substantially keep the x-ray tube 20 hermetically sealed while also permitting the shaft 31 to rotate. By keeping the x-ray tube 20 hermetically sealed, the system 30 thereby helps sustain a substantial vacuum in the chamber region 21 within the tube's vacuum vessel 22. With such a vacuum in the tube's vessel 22, electrons emitted from the cathode assembly 34 during operation are freely directed toward the anode assembly's disc 32 without their colliding with extraneous (i.e., interfering) gas or air molecules in the vessel's chamber region 21. Furthermore, in addition to helping keep out extraneous gas or air, the seal-and-bearing system 30 also serves to keep out particulates and other contaminants that may potentially be introduced into the vacuum vessel 22 of the x-ray tube 20. To help the system 30 maintain a substantial vacuum within the tube's vacuum vessel 22, any excessive amount of extraneous gas or air that is inadvertently introduced into the chamber region 21 of the vessel 22 is largely evacuated by means of a pump system 39. The pump system 39, in general, is activated as necessary by a gauge (not shown) that monitors the pressure within the tube's vessel 22.

"Computer-assisted tomography" (CAT), also known as "computed tomography" (CT), is a method of medical imaging and diagnosis that utilizes x-rays generated by an x-ray system, such as the x-ray system 11 shown in FIGS. 1, 2, and 3. During operation of such an x-ray system 11, as briefly mentioned hereinabove, a stream (i.e., beam) of electrons 35 is fired toward an anode assembly's rotating disc 32 within a vacuum vessel's high-vacuum chamber region 21. During such operation, a large number of x-rays is generated over a relatively short period of time, rather than a low number of x-rays over a longer period of time, for the former is better tolerated by human subjects or patients that are irradiated with such x-rays. To accomplish such, a high-power electron beam is utilized to bombard the anode assembly's rotating disc 32 so as to produce the x-rays 33. Such a process, however, as mentioned previously, generally results in the generation of high levels of heat and thus can cause radiation-induced degradation of the anode assembly's rotating disc 32. To help minimize such degradation, the shaft 31 on which the rotating disc 32 is mounted rotates very rapidly, for example, many thousands of revolutions per minute, so that a different anode surface area on the disc 32 is continuously presented to the electron beam 35. As the anode surface areas on the rotating disc 32 are continuously rotated out of the impinging electron beam's focus, the anode surface areas on the disc 32 are allowed sufficient time to cool before being re-introduced into the electron beam's focus, thereby minimizing degradation of the disc 32. Since such an x-ray system 11 within a CT imaging system (i.e., scanner) is typically mounted on a spinning annular gantry that violently accelerates and decelerates so as to rotate back and forth around each human patient to irradiate (i.e., scan) an anatomical region of interest (ROI) from various different angles in a short period of time, the overall weight of the x-ray system 11 is preferably made as low as possible. In this way, the total g-force of the x-ray system 11 as it rotates on the gantry is minimized, thereby helping to ensure mechanical and operational stability of the overall CT imaging system during operation.

Figure 4:
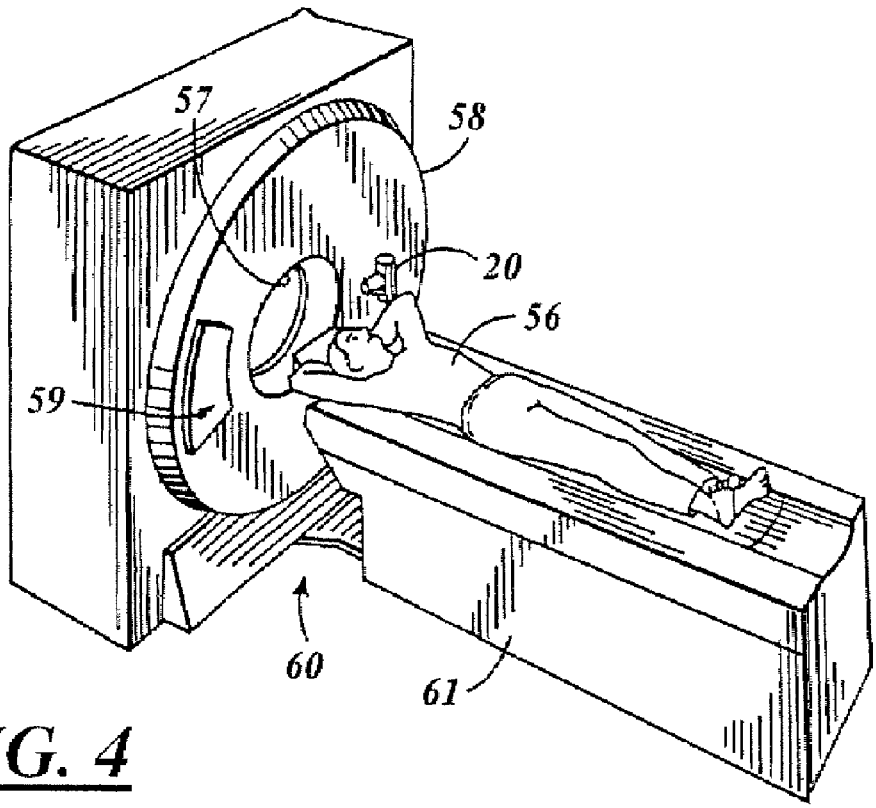
FIG. 4 illustrates a perspective view of a computed tomography (CT) imaging system, which is shown to include a rotatable gantry with an x-ray tube mounted thereon.
Figure 5:
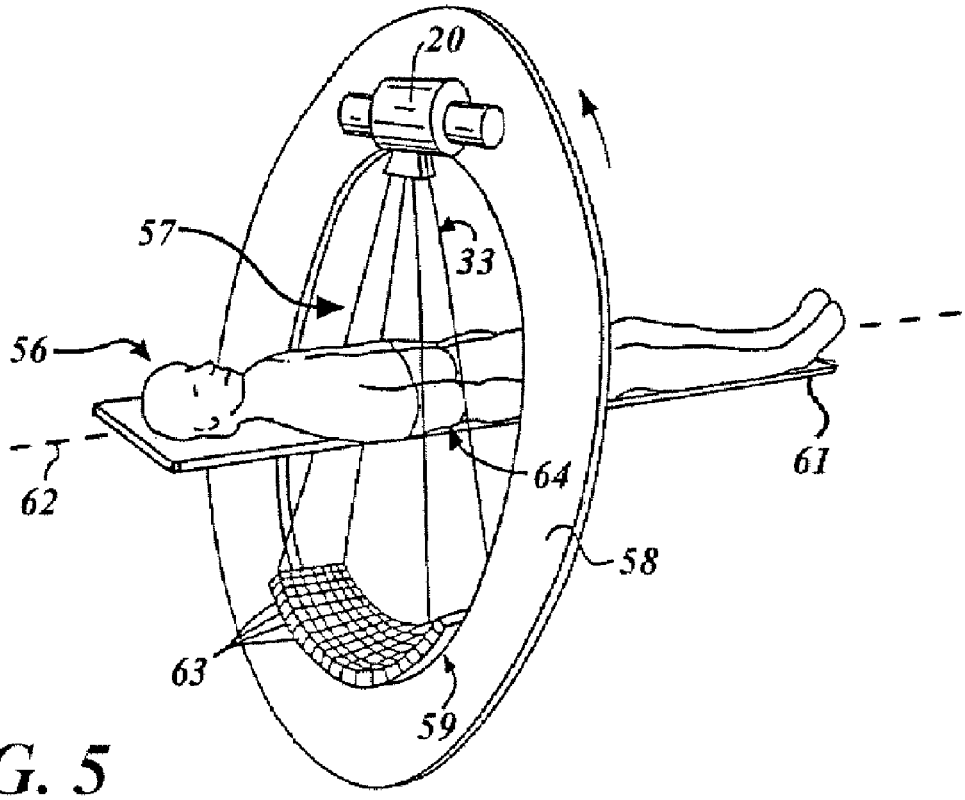
FIG. 5 illustrates a perspective view of the rotatable gantry depicted in FIG. 4. In this view, operation of the x-ray tube on the gantry is highlighted.

To illustrate how the x-ray system 11 is both mounted and incorporated in a CT imaging system, FIGS. 4 and 5 show perspective views highlighting some of the primary scanning elements in a largely conventional computed tomography (CT) imaging system 60. As shown, the CT imaging system 60 includes an elongated patient table 61, an annular gantry 58, an x-ray system tube 20, and an arcuate detector 59. In general, the patient table 61 is situated within an aperture or opening 57 defined within the gantry 58 so as to be collinearly aligned with an axis 62 defined through the center of the gantry's opening 57. As best shown in FIG. 5, the x-ray tube 20 is mounted at or near a 12 o'clock position on the gantry 58, and the detector 59 is mounted at or near a 6 o'clock position on the gantry 58.

For operation of the CT imaging system 60 in FIGS. 4 and 5, a subject or patient 56 is laid upon the patient table 61, and the table 61 is moved along the gantry axis 62 by an electric motor (not shown) so as to position a particular anatomical section or region of interest (ROI) 64 within the patient 56 underneath the x-ray tube 20. Once the patient 56 is aligned underneath the x-ray tube 20 as desired, movement of the patient table 61 is then arrested so as to immobilize both the table 61 and the patient 56. After the table 61 and patient 56 are immobilized, the gantry 58 is activated and thereby proceeds to rotate or spin about the patient 56 lying on the table 61. As the gantry 58 spins, the x-ray tube 20 emits a fan-shaped beam of x-rays 33 toward the patient 56. In this way, the patient's ROI 64 is thoroughly irradiated with x-rays 33 from many different angles. As the x-rays 33 attempt to pass through the patient 56 during such irradiation, the x-rays 33 are individually absorbed or attenuated (i.e., weakened) at various differing levels depending on the particular biological tissues existing within the ROI 64. These differing levels of x-ray absorption or attenuation are sensed and detected by an array of x-ray detector elements 63 included within the detector 59 and situated opposite the x-ray tube 20. Based on these differing levels as detected, the CT imaging system 60 is able to generate x-ray strength profiles and therefrom "construct" digital images of the patient's ROI 64 with the help of data-processing computers (not shown). Upon constructing such images, the images may be visibly displayed on a computer monitor (not shown) so that a doctor or other medical professional can indirectly observe and examine the ROI 64 within the patient 56. After conducting such an examination, the doctor can then accurately diagnose a patient's malady and prescribe an appropriate treatment.

As alluded to previously, the internal structures and components within an x-ray tube's vacuum vessel 22 are typically subjected to very high thermal stresses. In some instances, such thermal stresses are excessive and undesirable for proper operation of the x-ray tube 20 itself. In these instances, merely enclosing the tube's vacuum vessel 22 in the casing 28 filled with cooling fluid 26 so as to help remove heat from the vessel 22 is generally not sufficient, and a supplemental means for cooling the tube's vessel 22 is generally desirable. One way to further help cool the tube's vacuum vessel 22 is to install a system or structure in the chamber region 21 of the vessel 22 for collecting electrons that are backscattered from the anode assembly's rotating disc 32. In this way, the thermal energies and heat attributable to all collected electrons can then be transferred and removed from the tube's vacuum vessel 22.

Figure 6:
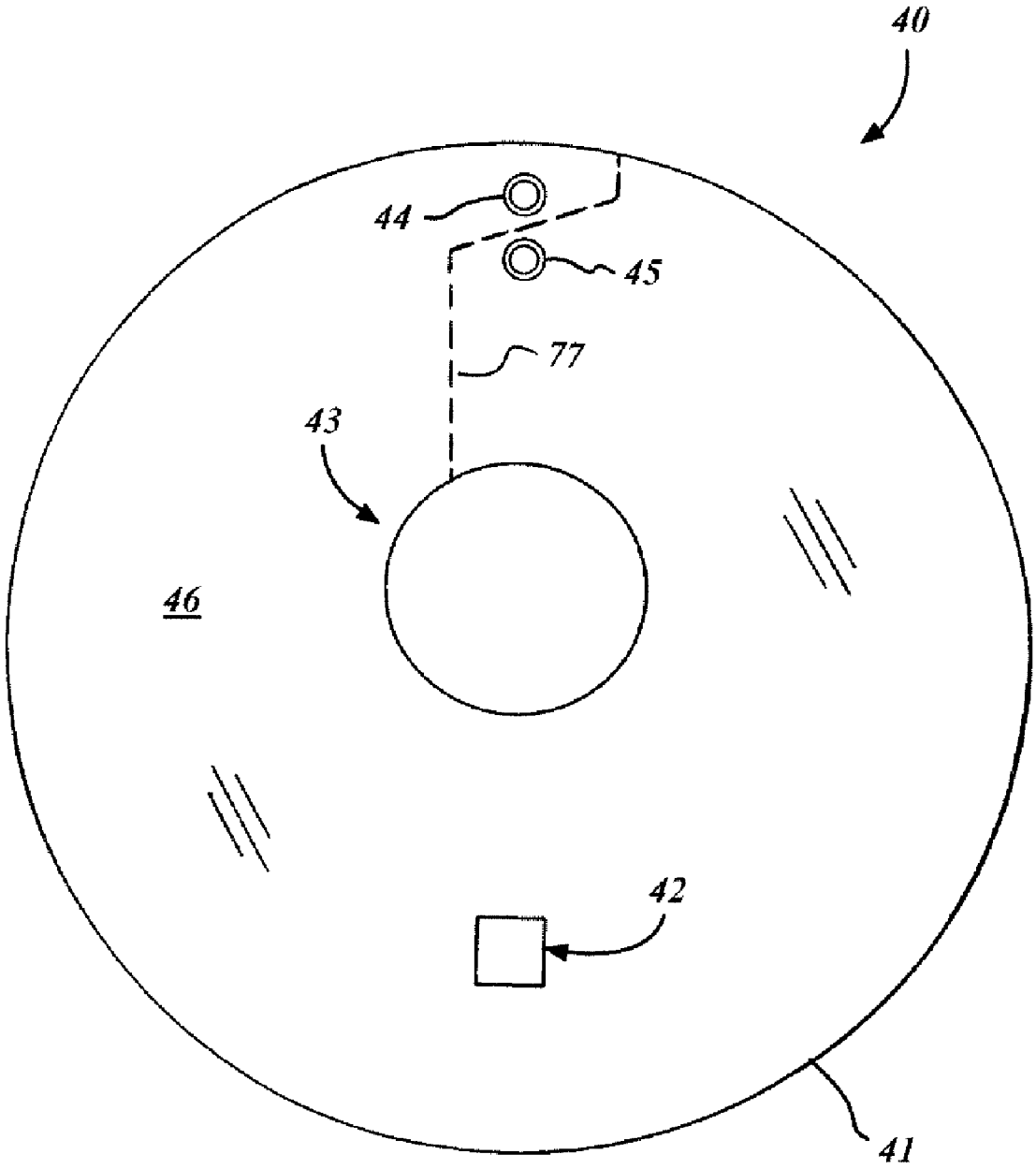
FIG. 6 illustrates a plan view of a structure for collecting scattered electrons.

FIG. 6 illustrates a plan view of a structure 40 for collecting scattered electrons. As shown, the electron-collecting structure 40 has both a hole 43 and an aperture 42 defined therethrough. Though the hole 43 is substantially circular and the aperture 42 is substantially square or rectangular as shown, both the hole 43 and the aperture 42 in alternative embodiments may have other shapes as well. Furthermore, though the electron-collecting structure 40 as shown has a circular outer periphery 41 and is thus generally shaped as a disc, the structure 40 in alternative embodiments may take on other shapes as well.

Figure 7:
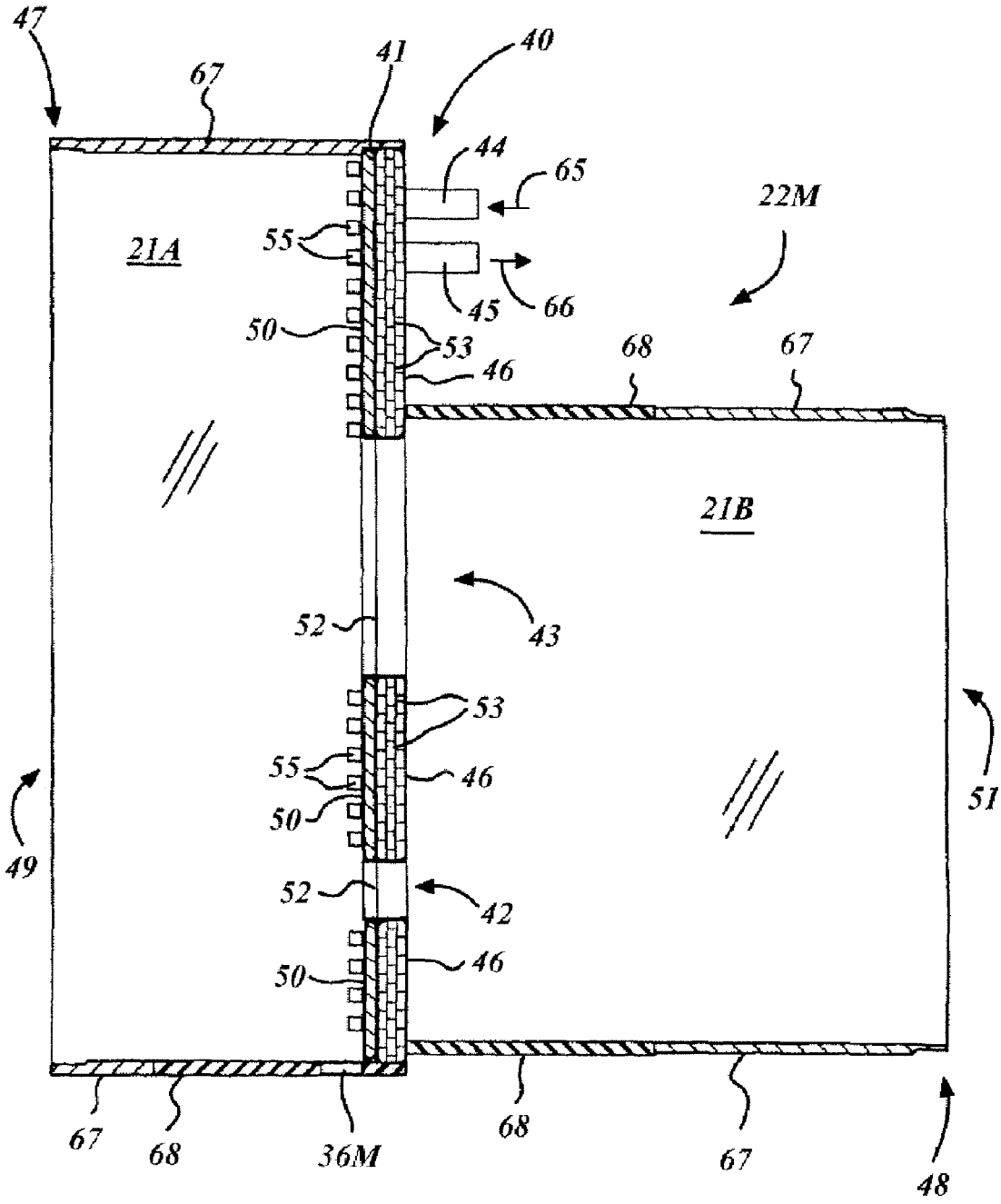
FIG. 7 illustrates a cutaway side view of the electron-collecting structure depicted in FIG. 6. In this view, the structure is shown centrally mounted within an open-ended vessel.

FIG. 7 illustrates a cutaway side view of the electron-collecting structure 40 depicted in FIG. 6. In this view, the structure 40 is generally centrally mounted within a vacuum vessel 22M that is suitable for incorporation within an x-ray tube. The vacuum vessel 22M itself includes various material sections 67 and 68 and has both an open anode end 47 and an open cathode end 48. Mounted as such within the vacuum vessel 22M, the structure 40 thereby generally defines both a first chamber region 21A and a second chamber region 21B in the vessel 22M. Though the outer periphery 41 of the structure 40 is mounted in the vessel 22M with a weld joint in FIG. 7, the structure's periphery 41 in alternative embodiments may be mounted to the vessel 22M with other types of joints as well.

As shown in FIG. 7, the electron-collecting structure 40 includes a two-sided first plate 50, a two-sided second plate 46, a fluid inlet 44, and a fluid outlet 45. The first plate 50, first of all, is generally both electrically conductive and thermally emissive and is centrally mounted within the vacuum vessel 22M. Though other constituent materials are possible, the first plate 50 preferably comprises an electrically conductive metal such as, for example, copper. In addition, the first plate 50 also preferably has a thermally emissive outer coating such as, for example, an iron oxide coating. Furthermore, as illustrated in FIG. 7, the first plate 50 also has a plurality of thermally emissive fins 55 protruding from its first side. As shown, the fins 55 generally extend toward the anode end 47 of the vacuum vessel 22M.

As is the first plate 50, the second plate 46 too is thermally emissive. Though other constituent materials are possible, the second plate 46 comprises stainless steel and is "greened" with a thermally emissive outer coating such as, for example, a chromic oxide coating. As shown in FIG. 7, the second plate 46 has a first side that is substantially conterminous with the second side of the first plate 50. Though the second side of the first plate 50 and the first side of the second plate 46 are particularly made conterminous with a weld joint 52 in FIG. 7, the first plate 50 and the second plate 46 in alternative embodiments may be joined by other types of joints or even be substantially integral with each other.

As further illustrated in the cutaway view of FIG. 7, the second plate 46 is at least partially hollow and has an internal conduit for conveying a heat-absorbing fluid generally throughout the recesses within the plate 46. The heat-absorbing fluid itself may be a liquid such as, for example, a dielectric oil, a mineral oil, or even a water-based coolant. Within its hollow, the second plate 46 includes a plurality of thermally conductive fins 53 that protrude into its internal conduit. Situated as such, the fins 53 are able to physically interact with any fluid or liquid that flows through the second plate's internal conduit. Furthermore, in addition to protruding into the second plate's internal conduit, these same fins 53 also extend through the first side of the second plate 46 so as to be in thermally conductive contact with the second side of the first plate 50.

To help facilitate the introduction of a heat-absorbing fluid into the second plate's internal conduit, the aforementioned fluid inlet 44 is mounted on the second side of the plate 46 so as to be in fluid communication with the plate's internal conduit. In this way, fluid can be circulated into the second plate's internal conduit via the inlet 44 in a direction 65. In addition, to help facilitate the removal of fluid from the second plate's internal conduit, the fluid outlet 45 is similarly mounted on the second side of the plate 46 so as to also be in fluid communication with the plate's internal conduit. In this way, fluid can be circulated out of the internal conduit and away from the second plate 46 via the outlet 45 in a direction 66. Furthermore, to help ensure that fluid is fully circulated throughout the internal recesses of the second plate 46, the plate 46 includes a septum 77 within its hollow, as shown in FIG. 6. Provided with such, the second plate 46 thereby causes fluid to internally circulate around its hole 43 as it passes through the plate 46.

Figure 8:
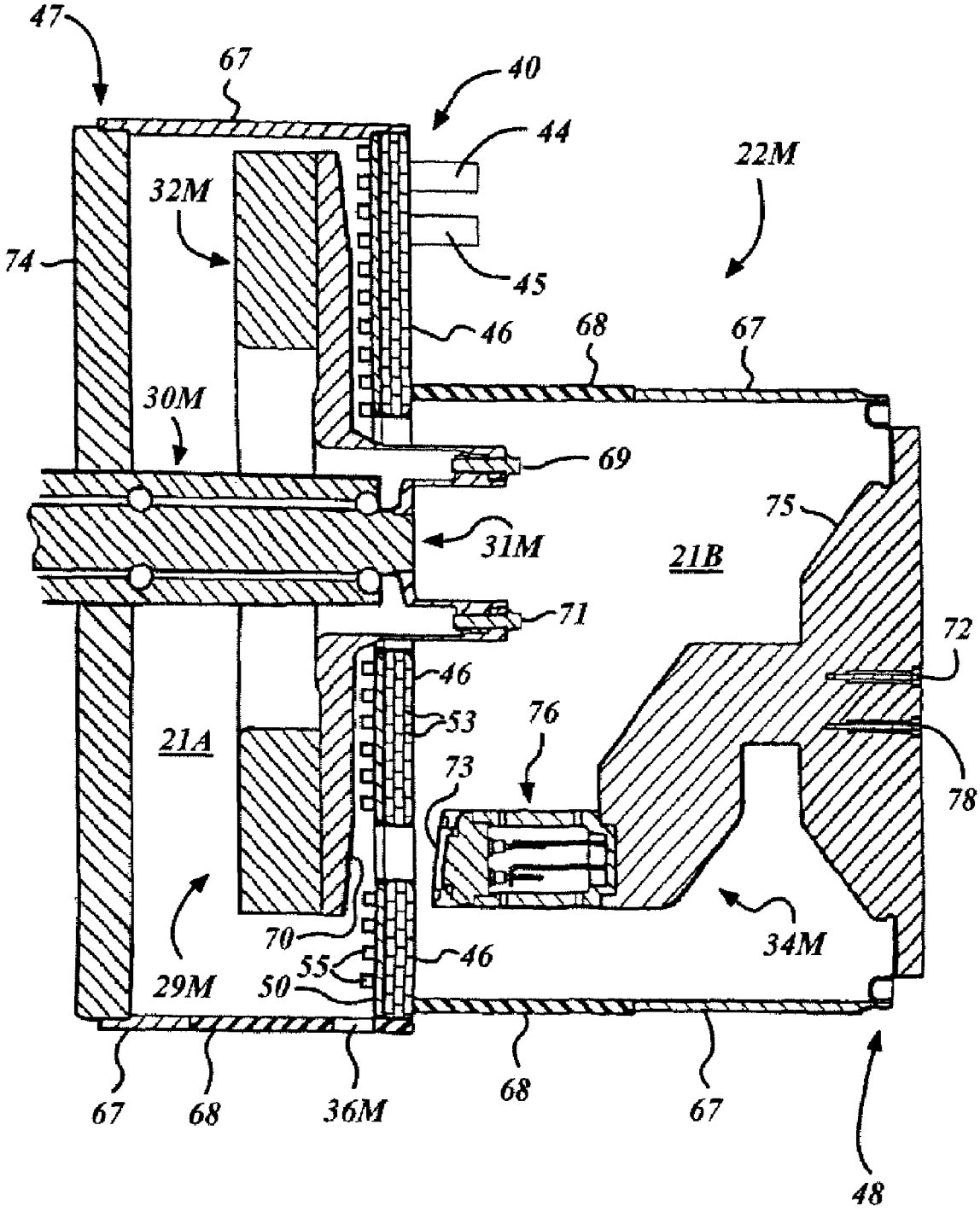
FIG. 8 illustrates another cutaway side view of the electron-collecting structure mounted within the vessel as depicted in FIG. 7. In this view, an anode assembly and a cathode assembly are additionally installed in the vessel's opposite ends so that the structure is situated between the two assemblies.

FIG. 8 illustrates another cutaway side view of the electron-collecting structure 40 mounted within the vacuum vessel 22M as depicted in FIG. 7. In this view, however, an anode assembly 29M is additionally mounted and installed in an opening 49 at the vacuum vessel's anode end 47, and a cathode assembly 34M is installed in an opening 51 at the vessel's cathode end 48. In such a configuration, the electron-collecting structure 40 is thereby interposed and situated between the anode assembly 29M and the cathode assembly 34M.

As shown in FIG. 8, the anode assembly 29M generally includes a mount 74, a seal-and-bearing system 30M, a rotatable shaft 31M, and a disc 32M. The mount 74 is generally installed and welded within the vacuum vessel's opening 49 so as to help keep the vessel 22M hermetically sealed. The seal-and-bearing system 30M, on the other hand, is disposed within the mount 74 to help support extension of the shaft 31M into the first chamber region 21A of the vessel 22M. Situated as such, the seal-and-bearing system 30M also facilitates rotation of the shaft 31M while at the same time helping maintain the vacuum vessel's hermetic seal. As further shown in FIG. 8, the disc 32M is fixedly mounted on the end of the shaft 31M with a plurality of bolts 69 and 71. Upon being mounted as such, the intended target surface 70 on the face of the disc 32M is thereby preferably spaced away from the first side of the structure 40 at a distance of about 4 to 6 millimeters, and more preferably a distance of about 4.5 to 5.5 millimeters.

As highlighted in FIG. 8, the hole 43 defined through the structure 40 physically accommodates the shaft 31M by permitting the shaft 31M to freely protrude through the structure 40. In this way, the bolts 69 and 71 that fix the disc 31M onto the end of the shaft 31M are situated in the vessel's second chamber region 21B instead of its first chamber region 21A. Such is desirable because any excessive heat generated in the vacuum vessel's first chamber region 21A during operation is thereby less likely to adversely affect the respective structural integrities of the bolts 69 and 71 as they retain the disc 32M on the end of the shaft 31M.

As additionally shown in FIG. 8, the cathode assembly 34M generally includes a mount 75 and an electron emitter 76. The mount 75 is generally installed and welded within the vacuum vessel's opening 51 so as to help keep the vessel 22M hermetically sealed. In its base, the mount 76 includes electrical connectors 72 and 78 for connecting the overall cathode assembly 34M to an electrical power supply (i.e., voltage source) 38M. The electron emitter 76, on the other hand, includes an energizable filament 73 and is mounted on a portion of the mount 75 that extends toward the aperture 42 defined through the structure 40. Mounted as such, the electron emitter 76 is thereby directly aligned, via the aperture 42 in the structure 40, with the target surface or track 70 defined on the anode assembly's rotatable disc 32M.

Figure 9:
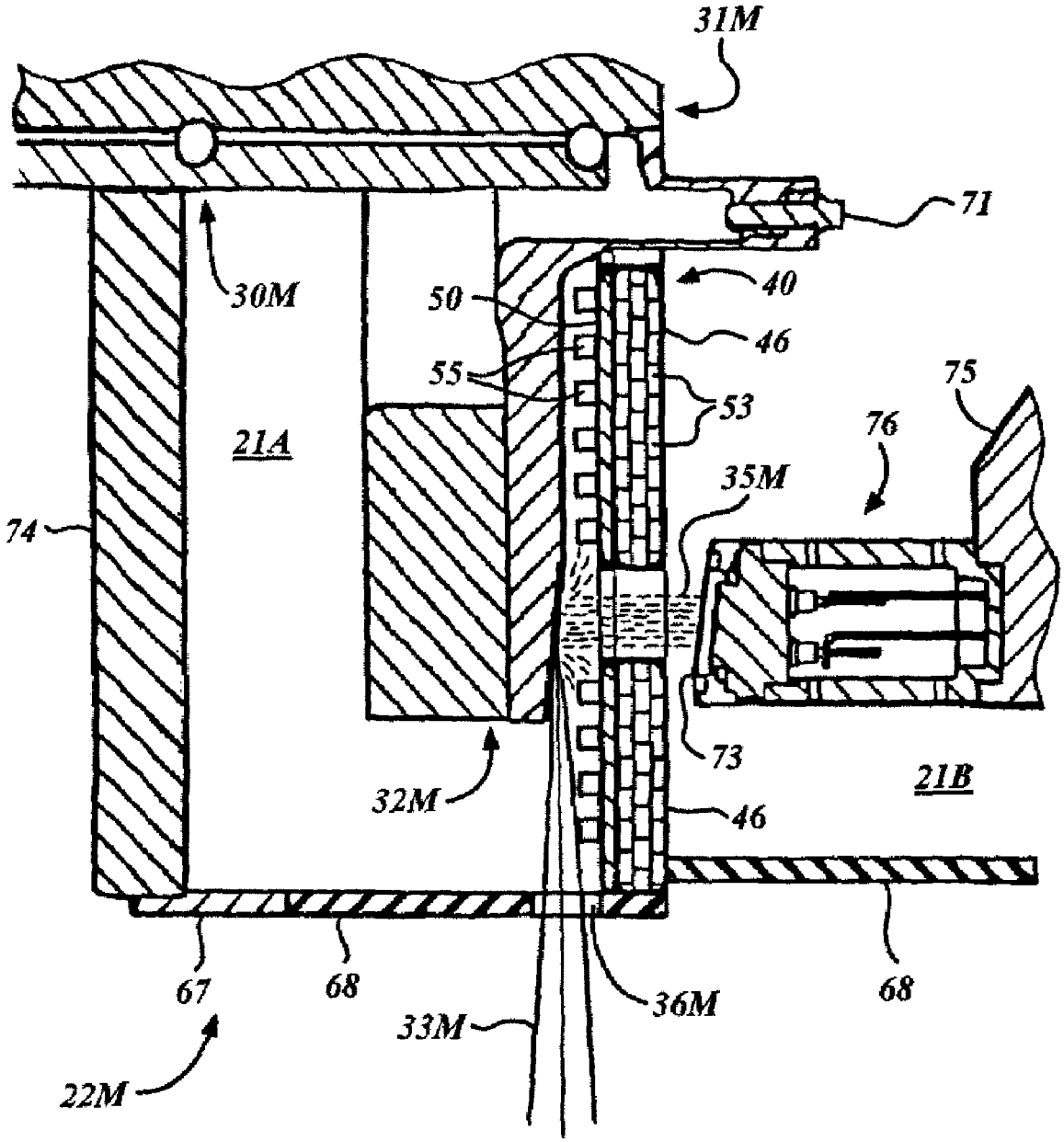
FIG. 9 illustrates another cutaway side view of the electron-collecting structure, anode assembly, cathode assembly, and vessel depicted in FIG. 8. In this view, electrons are shown being passed from the electron-emitting cathode assembly and to the electron-attracting anode assembly so as to produce x-rays. Also in this view, some of the electrons impinging on the anode assembly are shown backscattered toward the electron-collecting structure.
Figure 10:
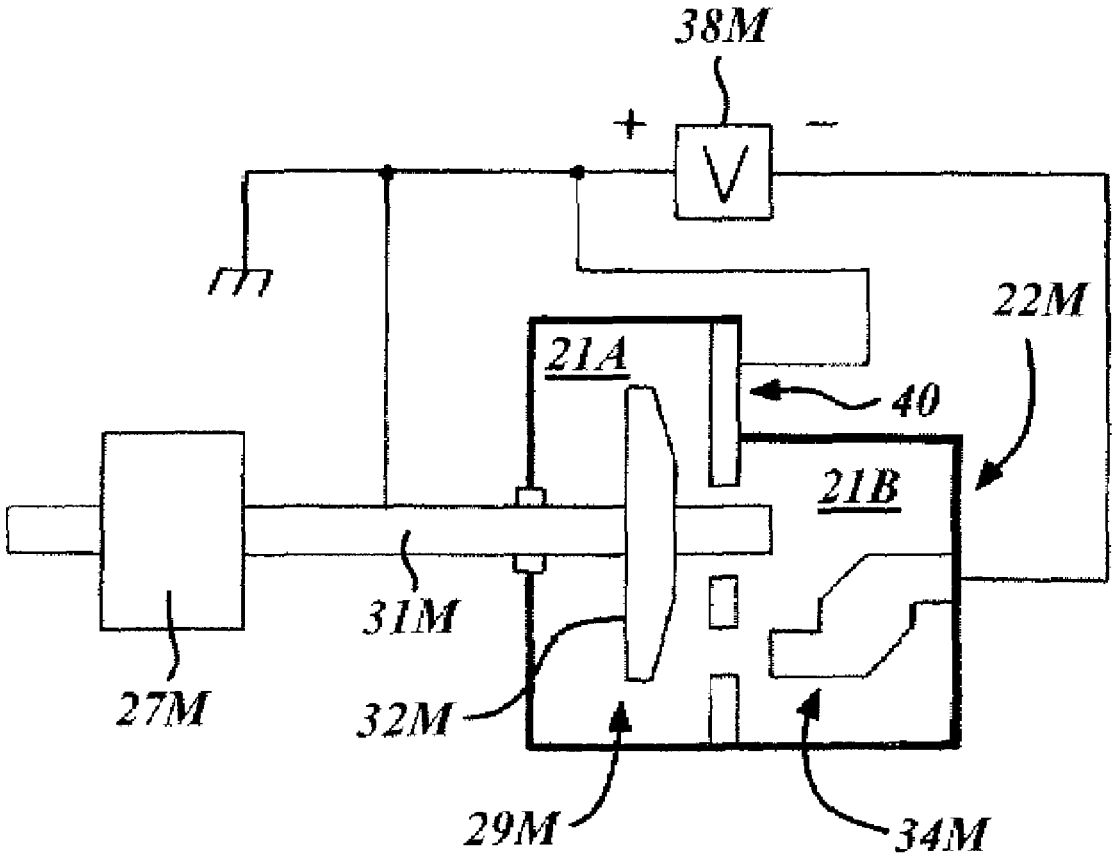
FIG. 10 illustrates a system diagram of an x-ray tube that includes the electron-collecting structure, anode assembly, cathode assembly, and vessel depicted in FIG. 8. In this diagram, both the electron-collecting structure and the anode assembly are shown electrically grounded.

During operation, the anode assembly 29M, the electron-collecting structure 40, and the cathode assembly 34M are all electrically connected to an electrical power supply (i.e., voltage source) 38M in a somewhat modified uni-polar type configuration as shown in the system diagram of FIG. 10. In this configuration, both the anode assembly 29M and the structure 40 are electrically grounded, and the cathode assembly 34M is maintained at a high negative voltage potential. As a result of this electrical configuration, a focused stream of electrons 35M is emitted from the filament 73 of the cathode assembly 34M, through the aperture 42 in the structure 40, and toward the disc 32M of the anode assembly 29M, as shown in FIG. 9. As the electron stream 35M impinges on the target surface or track 70 of the disc 32M, a driving induction motor 27M operates to rotate the shaft 31M and disc 32M together at a very high rate of angular speed. In this way, as electrons from the directed electron stream 35M are absorbed and/or deflected at the target surface 70 of the rotating disc 32M, x-rays 33M are ultimately produced which pass through an x-ray transmissive window 36M situated in the wall of the vacuum vessel 22M.

In addition to producing the x-rays 33M, this same operation also produces many electrons that are backscattered from the disc's target surface 70 as particularly shown in FIG. 9. Since the first plate 50 of the structure 40 is electrically charged by the power supply 38M, many of these backscattered electrons are electrostatically attracted to both the fins 55 and the first side of the first plate 50. As the backscattered electrons are attracted to the first plate 50, the electrons ultimately impinge on the plate 50 and transfer their respective kinetic energies to the plate 50 in the form of thermal energy (i.e., heat). Since the first plate 50 is in thermally conductive contact with the fins 53 in the second plate 46 and is also conterminous with the second plate 46, the thermal energy attributable to impinging electrons in the first plate 50 is thereby transferred to any heat-absorbing fluid or liquid that is circulated into the second plate's internal conduit via the inlet 44. By design, the thermally conductive fins 53 internally protruding into the second plate's internal conduit significantly help increase the effective transfer rate of thermal energy from both the first plate 50 and the second plate 46 to the fluid. As the fluid absorbs thermal energy from both the first plate 50 and the second plate 46, the fluid is circulated out of the internal conduit and away from the plates 50 and 46 via the outlet 45. In this way, thermal energy and heat attributable to backscattered electrons is effectively removed from both the structure 40 and the vacuum vessel 22M.

Furthermore, in addition to producing x-rays and backscattered electrons, the hot target surface 70 on the disc 32M during operation also radiates large amounts of heat. By design, much of this radiant heat is effectively absorbed by the emissive fins 55 included on the structure 40. As the radiant heat is absorbed, thermal energy attributable thereto is transferred from the first plate 50 and to the heat-absorbing fluid circulating through the second plate's internal conduit so that the energy is effectively removed from both the structure 40 and the vacuum vessel 22M.

Lastly, in addition to the embodiment(s) discussed hereinabove, it is to be understood that the electron-collecting structure may take on various alternative embodiments as well. For example, in addition to the first plate having a plurality of thermally emissive fins protruding from its first side, the second plate may similarly have a plurality of thermally emissive fins protruding from its second side. Furthermore, though the electron-collecting structure described hereinabove largely comprises two separate plates that are joined in a substantially conterminous fashion, it is to be understood that the structure may alternatively comprise two plates that are substantially integral with each other or even a single substantially monolithic plate. In an embodiment comprising a single monolithic plate, for example, the plate itself may largely comprise an electrically conductive metal and be thermally emissive. Such a monolithic plate may have a plurality of thermally emissive fins protruding from its first side and also a plurality of thermally conductive fins protruding within and/or from its second side. At its second side, the monolithic plate may have a conduit for conveying and circulating a heat-absorbing fluid therethrough. The conduit itself may be situated either within or immediately alongside the second side of the plate so that the thermally conductive fins protrude into the conduit and physically interact with any fluid or liquid flowing therethrough. In this way, therefore, thermal energy attributable to any electrons collected on the first side of the plate is effectively transferred to the heat-absorbing fluid flowing through the conduit at the second side of the plate for ultimate removal.

While the present invention has been described in what are presently considered to be its most practical and preferred embodiments or implementations, it is to be understood that the invention is not to be limited to the particular embodiments disclosed hereinabove. On the contrary, the present invention is intended to cover various modifications and equivalent arrangements included within the spirit and scope of the claims appended herein below, which scope is to be accorded the broadest interpretation so as to encompass all such modifications and equivalent structures as are permitted under the law.

What is claimed is:

1. An electron-collecting structure for collecting scattered electrons within a substantially evacuated vessel that contains an electron-emitting cathode and an electron-attracting anode spaced apart therein, said electron-collecting structure comprising:

an electrically conductive and thermally emissive first plate mounted proximate to said anode within said vessel, said first plate having a first side at least partially facing said anode and a second side facing opposite said first side;

a thermally emissive and substantially planar second plate mounted proximate to said cathode within said vessel, said second plate having a first side that is substantially conterminous with said second side of said first plate and a second side at least partially facing said cathode, and said second plate having an internal conduit for conveying fluid within said second plate;

an inlet in fluid communication with said conduit in said second plate; and an outlet in fluid communication with said conduit in said second plate;

wherein a heat-absorbing fluid is circulated into said conduit in said second plate via said inlet, said first plate is electrically charged so as to attract scattered electrons to its first side, energy from attracted electrons is transferred as thermal energy from said first plate and to said fluid, and said fluid is circulated out of said conduit and away from said second plate via said outlet.

2. An electron-collecting structure according to claim 1, wherein said vessel has structure adapted for being incorporated in an x-ray tube.

3. An electron-collecting structure according to claim 1, wherein said anode has structure adapted for being mounted at the end of a rotatable shaft.

4. An electron-collecting structure according to claim 3, wherein said first plate has a hole defined therethrough, said second plate has a hole defined therethrough, and said hole in said first plate is substantially aligned with said hole in said second plate so as to cooperatively permit said end of said shaft to freely protrude through said structure.

5. An electron-collecting structure according to claim 1, wherein said anode has an electron-impinging target surface, and said first side of said first plate is spaced away from said target surface at a distance ranging from about 4 millimeters to about 6 millimeters.

6. An electron-collecting structure according to claim 1, wherein said first plate has a plurality of thermally emissive fins protruding from its first side.

7. An electron-collecting structure according to claim 1, wherein said first plate comprises copper.

8. An electron-collecting structure according to claim 7, wherein said first plate has an outer coating of iron oxide.

9. An electron-collecting structure according to claim 1, wherein said second plate has a plurality of thermally conductive fins internally protruding into said conduit.

10. An electron-collecting structure according to claim 1, wherein said second plate comprises stainless steel.

11. An electron-collecting structure according to claim 10, wherein said second plate has an outer coating of chromic oxide.

12. An electron-collecting structure according to claim 1, wherein both said first plate and said second plate are interposable between said anode and said cathode, said first plate has an aperture defined therethrough, said second plate has an aperture defined therethrough, and said aperture in said first plate is substantially aligned with said aperture in said second plate so as to cooperatively permit electrons to freely pass through said structure.

13. An electron-collecting structure according to claim 12, wherein said aperture in said first plate and said aperture in said second plate are each substantially rectangular.

14. An electron-collecting structure according to claim 1, wherein said first plate and said second plate are substantially integral with each other.

15. An electron-collecting structure according to claim 1, wherein said heat-absorbing fluid is a liquid selected from the group consisting of a dielectric oil, a mineral oil, and a water-based coolant.

16. A structure for collecting scattered electrons within a substantially evacuated vessel that contains an electron-emitting cathode and an electron-attracting anode spaced apart therein, said structure comprising:

an electrically conductive and thermally emissive first plate mounted between said anode and said cathode within said vessel, said first plate having a first side at least partially facing said anode and a second side facing opposite said first side, and said first plate having an aperture extending therethrough;

a thermally emissive and substantially planar second plate having a first side that is substantially conterminous with said second side of said first plate and a second side at least partially facing said cathode, said second plate having an aperture extending therethrough, and said second plate having an internal conduit for conveying fluid within said second plate;

an inlet in fluid communication with said conduit in said second plate; and an outlet in fluid communication with said conduit in said second plate;

wherein a heat-absorbing fluid is circulated into said conduit in said second plate via said inlet, said aperture in said first plate is substantially aligned with said aperture in said second plate so as to cooperatively permit electrons to freely pass through said structure, said first plate is electrically charged so as to attract scattered electrons to its first side, energy from attracted electrons is transferred as thermal energy from said first plate and to said fluid, and said fluid is circulated out of said conduit and away from said second plate via said outlet.

17. A structure according to claim 16, wherein said first plate has a plurality of thermally emissive fins protruding from its first side.

18. A structure according to claim 16, wherein said second plate has at least one of a plurality of thermally conductive fins internally protruding into said conduit and a plurality of thermally emissive fins protruding from its second side.

19. A structure for collecting scattered electrons within a substantially evacuated vessel that contains an electron-emitting cathode and an electron-attracting anode spaced apart therein, said structure comprising:

an electrically conductive and thermally emissive first plate mounted between said anode and said cathode within said vessel, said first plate having a first side with a plurality of thermally emissive fins protruding therefrom and at least partially facing said anode, said first plate having a second side facing opposite said first side, and said first plate having an aperture extending therethrough;

a thermally emissive and substantially planar second plate having a first side that is substantially conterminous with said second side of said first plate, said second plate having a second side at least partially facing said cathode, said second plate having an aperture defined therethrough, and said second plate having an internal conduit for conveying fluid within said second plate;

an inlet in fluid communication with said conduit in said second plate; and an outlet in fluid communication with said conduit in said second plate;

wherein a heat-absorbing fluid is circulated into said conduit in said second plate via said inlet, said aperture in said first plate is substantially aligned with said aperture in said second plate so as to cooperatively permit electrons to freely pass through said structure, said first plate is electrically charged so as to attract scattered electrons to its first side, energy from attracted electrons is transferred as thermal energy from said first plate and to said fluid, and said fluid is circulated out of said conduit and away from said second plate via said outlet.

20. A structure according to claim 19, wherein said second plate has a plurality of thermally conductive fins internally protruding into said conduit.

21. A structure for collecting scattered electrons within a substantially evacuated vessel that contains an electron-emitting cathode and an electron-attracting anode spaced apart therein, said structure comprising:

a first plate mounted between said anode and said cathode within said vessel, said first plate having a first side and a second side;

a substantially planar second plate having a first side that is substantially conterminous with said second side of said first plate and a second side, said second plate having an internal conduit for conveying fluid within said second plate;

an inlet in fluid communication with said conduit in said second plate; and an outlet in fluid communication with said conduit in said second plate.

22. A structure according to claim 21, wherein a heat-absorbing fluid is circulated into said conduit in said second plate via said inlet and said heat-absorbing fluid is circulated out of said conduit and away from said second plate via said outlet.

23. A structure according to claim 21, wherein said first plate includes a plurality of thermally emissive fins protruding from its first side towards said anode.

24. A structure according to claim 21, wherein said second plate includes a plurality of thermally conductive fins that protrude into the internal conduit, wherein said fins extend from said first side of the second plate and are in thermally conductive contact with said second side of the first plate.

25. A structure according to claim 21, wherein said second plate includes a septum extending through the internal conduit.

* * * * *